US009393570B2

(12) United States Patent
Schwelling

(10) Patent No.: US 9,393,570 B2
(45) Date of Patent: Jul. 19, 2016

(54) DOCUMENT SHREDDER

(71) Applicant: Hermann Schwelling, Salem (DE)

(72) Inventor: Hermann Schwelling, Salem (DE)

( * ) Notice: Subject to any disclaimer, the term of this patent is extended or adjusted under 35 U.S.C. 154(b) by 123 days.

(21) Appl. No.: 13/953,634

(22) Filed: Jul. 29, 2013

(65) Prior Publication Data

US 2014/0084091 A1 Mar. 27, 2014

(30) Foreign Application Priority Data

Jul. 30, 2012 (DE) ..... 10 2012 106 915

(51) Int. Cl.
*B02C 25/00* (2006.01)
*B02C 18/00* (2006.01)

(52) U.S. Cl.
CPC ..... *B02C 25/00* (2013.01); *B02C 18/0007* (2013.01); *B02C 2018/0038* (2013.01)

(58) Field of Classification Search
CPC ..... B02C 25/00; B02C 18/0007; B02C 2018/0038; B02C 2018/164
USPC ..... 241/36, 100, 236, 295
See application file for complete search history.

(56) References Cited

U.S. PATENT DOCUMENTS

| | | | | |
|---|---|---|---|---|
| 4,817,877 | A * | 4/1989 | Itoh | B02C 18/0007 241/225 |
| 6,616,528 | B2 | 9/2003 | Wolters et al. | |
| 7,721,982 | B2 | 5/2010 | Schwelling | |
| 2006/0016919 | A1 * | 1/2006 | Castronovo | 241/34 |
| 2010/0090038 | A1 * | 4/2010 | Jensen | 241/30 |
| 2010/0187341 | A1 | 7/2010 | Schwelling | |
| 2012/0001001 | A1 | 1/2012 | Schwelling | |

FOREIGN PATENT DOCUMENTS

| | | | |
|---|---|---|---|
| DE | 3819285 | A1 | 12/1989 |
| DE | 4124669 | A1 | 1/1993 |
| DE | 19525027 | A1 | 1/1997 |

* cited by examiner

*Primary Examiner* — Mark Rosenbaum
(74) *Attorney, Agent, or Firm* — Kolisch Hartwell, P.C.

(57) ABSTRACT

The invention relates to a document shredder (1), comprising a cutting unit (4), a motor (3) for driving the cutting unit (4), and a motor control system (2). The document shredder (1) additionally has a path measuring device (13), wherein the motor control system (2), by means of the path measuring device (13), determines the length of the already shredded portion of the document to be shredded, and the motor control system (2) controls the motor (3) in dependence on the measured length of the already shredded portion of the document to be shredded.

43 Claims, 2 Drawing Sheets

DOCUMENT SHREDDER

CROSS-REFERENCE TO RELATED APPLICATIONS

This application claims priority to German Patent Application No. 102012106915.8 and entitled AKTENVERNICHTER (document shredder).

FIELD OF APPLICATION

The invention relates to a document shredder and to a method for operating such a document shredder.

TECHNICAL BACKGROUND

Document shredders are used to destroy documents (i.e. files) having confidential content. By such documents should primarily be understood (paper) sheets, but also binders, diskettes, CDs or other data carriers.

For the destruction, i.e. for the shredding of the documents, a document shredder has a motor-operated cutting unit, which dissects the document to be shredded. For this, the document shredder has a document feeder and a container which receives the dissected documents.

One problem with document shredders consists in the fact that these can be overloaded by the introduction of over-thick documents, in particular of too many sheets. In order to forestall an overload which is harmful to the document shredder and to prevent a paper jam or paper blockage, ordinary document shredders automatically shut down at a predetermined load limit value, i.e. they shut off the drive of their cutting unit and, where necessary, trigger a reversing operating mode, by which the drive direction of the motor is reversed and by which the document to be shredded is fed back out.

In addition, it is known from the prior art to equip document shredders with a turbo mode, in which the torque of the motor driving the cutting unit is increased.

DE 195 25 027 A1 shows, for example, a document shredder, the cutting unit of which is driven by a drive motor configured as a capacity motor having an operating capacitor. In the event of an overload of the drive motor of the cutting unit, said drive motor is operated for a short time in reversing operating mode and switched off. After this, an auxiliary capacitor, which can be connected in parallel to the operating capacitor of the drive motor, is briefly switched on, preferably for one document passage, whereby the torque of the drive motor can be increased.

On said document shredder, it is disadvantageous that, if the drive motor is overloaded, a turbo mode is in any event activated by connection of the auxiliary capacitor. In many cases, a manual removal of the paper from the document shredder may however be more appropriate. It should here also be borne in mind that the connection of the auxiliary capacitor leads to an—even if only temporary present—overstraining and heating of the drive motor, but also of the drive transmission and of the cutting unit. The turbo mode should thus be activable only in exceptional cases.

Examples of document shredders are disclosed in U.S. Pat. Nos. 7,721,982 and 6,116,528, U.S. Patent Publication Nos. US20100187341 and US20120001001, and German Patent Publication No. DE19525027A1. The disclosures of these and all other publications referenced herein are incorporated by reference in their entirety for all purposes.

Advantages of the present disclosure will be more readily understood after considering the drawings and the Detailed Description.

REPRESENTATION OF THE INVENTION a) Object Definition

The object of the present invention is therefore to provide an intelligent document shredder which works in a manner appropriate to the situation. In addition, the object of the invention is to provide a corresponding method for operating a document shredder.

b) Achievement of the Object

This object is achieved by virtue of the features of claims 1 and 23. Advantageous embodiments emerge from the subclaims.

The invention proposes a document shredder comprising a cutting unit, a motor for driving the cutting unit, and a motor control system. According to the invention, the document shredder additionally has a path measuring device. The path measuring device is here designed to determine the length of the already shredded portion of the document to be shredded. It transmits this measurement information to the motor control system. The length of the already shredded portion is therefore constituted by that length over which the document has already been shredded. In dependence on the measured length of the already shredded portion of the document to be shredded, the motor control system controls the motor.

In the invention, a situation-appropriate working of the document shredder is hence possible, since in this, given different feed-in lengths, i.e. lengths of the already shredded portion of the document, the motor can be controlled in a manner appropriate to the situation. The invention has namely made use of the insight that, if an event occurs, such as, for example, an overloading of the motor, in dependence on the shredding progress (determined by the path measuring device) different reactions of the motor control system constitute the respectively most optimal, i.e. most situation-appropriate solution.

Thus the document shredder, in particular, however, also its motor control system, can have a wide variety of means, such as, for example, sensors, for detecting such events. For example, it is conceivable for the document shredder to have means for measuring the load on the motor. The motor control system can then control the motor in dependence on the measured load on the motor.

It is also conceivable for the motor control system to have an overload limit which predefines a maximum load limit value for the motor. The maximum load limit value is preferably adjustable in dependence on the measured length of the already shredded portion of the document to be shredded.

It is thereby possible, should the maximally allowed load limit value be reached, for this load limit value to be raisable. According to the invention, this raising is preferably only effected, however, when the length of the already shredded portion has exceeded a predetermined shredding limit value, i.e. a predetermined length of the already shredded document. If an overload is detected directly after the start-up of the document shredder, i.e. given a shredding progress in which, for example, only 5 cm or less of the fed-in document have been shredded, for example, it is hence possible for the load limit value not to be raised, but for a reversing operating mode to be able to be manually triggered or be automatically triggered.

The invention is here namely based on the insight that a very early overloading of the motor implies that the document to be shredded, for example a stack of paper, is so thick that, even if the load limit value is raised, the motor is not designed for the load caused by the document. It should here be noted that the motor, after having started up, runs briefly at idle as long as no paper has yet been fed-in into the cutting unit.

During this period, the motor, jointly with the cutting unit and the transmission(s) disposed between the motor and the cutting unit, can hence build up a certain angular momentum. When the paper to be shredded enters into the cutting unit, this built-up angular momentum additionally supports the drive force of the drive motor. If thus only a slight overloading of the motor occurs, for example by a stack of paper with 1, 2 or 5 sheets too many being introduced into the document shredder, then the initially existing angular momentum is only slowly dispelled. In this case, an overloading of the motor is detected at the point of a relatively large shredding progress, for example when the stack of DIN A4 papers has already been 30, 40 or 50% fed-in in and shredded.

In this case, it is more appropriate to the situation to likewise shred the remaining part of the paper pile. On the one hand, the triggering of the reversing operating mode would namely lead to spoiling of the workplace by paper scraps of the expelled, already shredded portion of the paper pile, while, on the other hand, the necessary raising of the maximum load limit value which is necessary to shred the additional 1, 2 or 5 sheets is so small that the motor, the cutting unit and the interposed transmissions do not suffer damage as a result of this temporary raising.

The path measuring device can be realized in a variety of ways. For example, the path measuring device can measure a value representing the current shredding speed. Via the integration of the measured values, the length of the already shredded portion of the document to be shredded can then be calculated. In the simplest case, this solution can be realized at the feeder by means of a rotary encoder, such as, for example, a small wheel, which is turned by the fed-in document and thus generates a value for the shredding speed.

By summation, i.e. integration of the revolutions or part-revolutions of the small wheel of the rotary encoder, the length of the already shredded portion can then be determined. For this, it is sensible, of course, if the rotary encoder is disposed either on the cutting unit or at a chosen point on the drive train. The distance between a light barrier at the feeder of the document shredder, which triggers the starting of the drive motor, and the cutting unit, should fundamentally be taken into account, since the document to be shredded is namely shredded only after it has been fed-in in over this path. This distance should be jointly taken into account in the determination, i.e. should be subtracted from the length, calculated by integration, of the already shredded portion.

An alternative realization of such a path measuring device can consist in a circuit for measuring the fed-in current of a direct-current motor used as the drive motor. As is known, in a direct-current motor the fed-in current is namely inversely proportional to the motor speed. The measured current thus also constitutes a value representing the current shredding speed. By integrating the inversely proportional value to the value of the electric current, it is then possible to calculate the length of the already shredded portion of the document to be shredded. Account should here also possibly be taken of yet further parameters. In motors with series characteristic, such as, for example, in said direct-current motor, the path distance can generally be determined via the integral of the current consumption over time by means of a conversion algorithm.

The rotary encoder can also directly measure the rotation of the cutting unit. It can also, however, measure the rotation at the motor or at the transmission.

In an advantageous refinement of the inventive document shredder, the event of the dramatic rise in power consumption of the motor is likewise taken into account. This event can namely indicate that additional documents have been supplied, for example in overlapping arrangement or else directly following on from preceding documents (i.e. without leaving a gap between the documents). In such a case, the currently existing value of the path measuring device should be reset over the progress of the shredding and a new count initiated from zero. The aim of this is that a prolonged overload of the document shredder can be prevented. The dramatic rise can also be used as an indicator of the existence of such a strong overload which cannot itself be compensated by raising of the maximally permitted load limit value. In the scenario that additional documents are supplied in direct, i.e. immediate follow-up to preceding documents, it should be assumed that these additional documents constitute a significantly thicker stack than the preceding documents, which leads to the dramatic rise in current.

The recognition of the dramatic rise in current, as described above, is primarily only possible, however, in direct-current motors. If a capacitor motor, in which the load limit value can be raised by connection of an auxiliary capacitor, is used as the drive motor, however, then a current measurement for detecting the above-stated events is harder to achieve. It is therefore proposed that alternatively or additionally thereto, in the inventive document shredder, a length reference value can be provided, with which value the current length of the already shredded portion of the document to be shredded is compared. This length reference value can correspond, for example, to the length of a DIN A4 sheet, i.e. 29.7 cm. When the length reference value is reached, the meter of the path length measuring device is reset to zero. A prolonged overload of the document shredder can thus be prevented, since preferably, following the passage of the DIN A4 paper stack corresponding to the length reference value, the raised load limit value is reset to its original, lower value and hence a paper stack which has been introduced directly afterwards into the document shredder and which likewise (due to its thickness) could only be shredded if the load limit value were raised, cannot be shredded.

In this case, if the load limit value is thus once again reached, a renewed raising is preferably not possible, but instead only the reversing operating mode of the motor can be manually or automatically triggered, whereby the second paper stack is discharged from the document shredder. This mechanism thus prevents the document shredder from operating continuously and permanently in the merely temporarily permissible operating state of the raised load limit value.

As already mentioned, the load limit value should only be raised where the length of the already shredded portion of the document to be shredded has exceeded the predetermined shredding limit value. Otherwise, the reversing operating mode of the motor can preferably be triggered. This reversing operating mode can proceed until such time as the document is ejected again. Preferably, account is here taken of the length, registered by the path measuring device, of the already shredded portion of the document to be shredded, i.e. the reversing operating mode proceeds only for as long as the shredding operation is previously realized.

The triggering of the reversing operating mode and/or the raising of the load limit value can be effected automatically by the motor control system, but also alternatively or additionally manually, for example can be activated by means of one or more keys on the document shredder.

It is also conceivable, should the load limit value be reached, for the load limit value not to be raised immediately or for the reversing operating mode not to be triggered immediately, but rather for a reversing operating mode of the motor to be previously triggered on a temporary basis, i.e. for 1 to 5 seconds, for example. In this reversing operating mode, the document to be shredded should not however be fully ejected. Instead, the purpose is preferably to signal that the introduced document, i.e. for example the paper stack, was too thick. Thus the aim is thereby visually to indicate that the document has to be removed, though should not be directly be ejected because it otherwise falls out. After all, the operator very probably no longer has hold of the document. Since it would thus in this case fall out onto the ground together with the scraps, this would lead to spoiling of the workplace.

The motor can be constituted, for example, by a direct-current motor and/or a series-wound machine. The motor control system can predefine the load limit value by fixing a maximally permitted current for the operation of the motor and/or by fixing a maximally permitted motor torque and/or fixing a minimum rotation speed of the motor.

Alternatively, the motor can also however be constituted by a capacitor motor. The motor control system can increase the load limit value by the connection of at least one capacitor. In the capacitor motor, the motor usually jams when the maximum torque is reached. This is not a case of an active shut-off by the motor control system, but rather the motor control system recognizes, preferably via the aforementioned rotary encoder, that the cutting unit is jammed.

As already mentioned above, the load limit value can be raisable merely for a predetermined time or a predetermined, yet to be shredded path length. It is here possible for the motor control system to reset the load limit value after the predetermined time or the predetermined path length. At the same time, the motor control system can switch off the motor. Preferably, the path length is determined in dependence on the length of the already shredded portion of the document to be shredded. The motor should only be switched off, however, once other criteria too are met. By this is envisioned, for example, a presence signal of a document which is present, which presence signal is reported by a light barrier at the feeder. The load limit value could be reset on a time-dependent or else on a path-dependent basis, for example after the shredding of a length corresponding to a standard document length, such as, for example, of DIN A4. Advantageously, the motor subsequently continues to be operated for a predetermined run-on time or a predetermined run-on path length.

The invention likewise deals with a method for operating a document shredder. In this method, a document is fed in and shredded. For the method, the document shredder requires a motor. According to the invention, the method involves determining the length of the already shredded portion of the document to be shredded. The motor is here controlled in dependence on the measured length of the already shredded portion of the document to be shredded.

Preferably, the load on the motor is measured. The motor is hence preferably controlled in dependence on the measured load on the motor.

The actual load on the motor can be limited by a predefined, maximally allowed load limit value. An overload is preferably recognized on the basis of the reaching of the load limit value. The maximum load limit value can be adjustable in dependence on the measured length of the already shredded portion of the document to be shredded.

In the case of an overload, the motor can be operated in a turbo mode, in which the load limit value is raised. The turbo mode should only be able to be triggered, however, once the already shredded portion has exceeded a predetermined shredding limit value. For this, it is advantageous if a value representing the current shredding speed is measured. By integrating the measured values, it is then possible to calculate the length of the already shredded portion of the document to be shredded.

In the case of an overload, the motor can be operated in a reversing operating mode in order preferably to eject again the document to be shredded. This reversing operating mode should only take place, however, when the already shredded portion has not yet exceeded the predetermined shredding limit value. A cancelation of the turbo mode and/or of the reversing operating mode can be effected automatically and/or manually. It would also be conceivable for the reversing operating mode to be triggered automatically, while the turbo mode, i.e. the raising of the maximum load limit value, can be triggered only manually. However, the opposite triggering capability is also imaginable.

As already mentioned, the motor can be configured as a direct-current motor or as a series-wound machine. The particularly advantageous properties of direct-current motors, which properties are likewise present in series-wound machines, can thereby be utilized in the invention. According to the characteristics of direct-current motors, the torque rises strongly with falling rotation speed, i.e. the rotation speed is roughly inversely proportional to the torque. This applies, in particular, to direct-current motors, i.e. motors with permanently magnetic stator, or else to series-wound machines of any chosen construction, thus also to universal motors and/or single-phase series commutator motors operated with direct current or alternating current.

This means that the torque of the motor rises with increasing load, i.e. as a result of a thicker document to be shredded, since the rotation speed falls as a result of the higher load.

Since too high a torque, however, can lead to damaging or destruction of the transmission (where present) for transmitting the motor force to the cutting unit, and of the cutting unit itself, and since, moreover, the high currents generated in the rotor of the motor can cause the motor to overheat, the invention provides the above-stated overload limit, which predefines a maximum load limit value, i.e. a motor torque which is maximally allowed by the motor control system.

The maximum load limit value is solely, however, an upper limit defined by the motor control system, though the motor is capable of generating still higher loads, i.e. torques. Should this load limit value be reached, an optional raising of the load limit value, at least for a predetermined time, is preferably possible.

This has the advantage that the user, if he exercises this option of raising the load limit value, can cause the motor control system to continue to operate the motor in the feed-in direction, i.e. the direction of shredding, even though a higher torque is now allowed by the motor control system. At least the document which is currently in the feeder can thus be shredded with an increased torque. In the inventive solution, the absolute value of the maximally permitted torque is advantageously increased. It is therefore not a question of compensating a torque which decreases at low rotation speeds. By the raising of the load limit value, a turbo function of the document shredder is thus activated.

If a direct-current motor is used, the activation of the turbo function can be effected by an appropriate driving of the motor by the motor control system. More precisely, the activation of the turbo function is thus here effected by adapting the driving of those installed components which are in operation. It can thus be effected in a purely software-based manner. No connection of previously inactive components, as is the case in a capacity motor, is necessary.

The maximum load limit value to be set by the motor control system can be defined in a direct-current motor by different operating parameters of the motor, for example a maximally allowed current (i.e. a restriction of current) for the operation of the motor and/or by a maximally allowed motor torque and/or by a minimum rotation speed of the motor.

In order to establish whether a raising of the load limit value is to be made available, the motor control system compares the actual values of the motor operating parameters with the target values, i.e. it is established whether the actual load on the motor reaches the maximum load limit value. As motor operating parameters adopted for this purpose, the motor current and/or the motor speed and/or the motor torque can be provided.

The document shredder can have a sensor, in particular a light barrier or a rocker switch, which is disposed on the feeder of the document shredder, i.e. in the feed-in direction, directly before the cutting unit of the document shredder. If this sensor of the motor control system reports that no document is any longer detected, the operation of the motor is continued for an adjustable run-on time and then ended. Since the sensor is located just before the cutting unit in the feed-in direction, the fixedly set run-on time is preferably adjusted such that, after the expiry thereof, the document is completely dissected by the cutting unit. Since, after the expiry of the predetermined time, the document has been completely shredded, the maximum load limit value can now be reset again to its initial level and, in addition, the motor can be switched off.

Alternatively or additionally, it is also conceivable for the maximum load limit to be manually reset. This can be realized, in particular, by actuations of a main switch of the document shredder or by cut-off of the power supply to the document shredder.

In principle, the possibility exists that the maximum load limit value, after having already been raised, is reached once again. This is possible, for example, if the document is so thick that its shredding requires a torque which, even with raised load limit value, would exceed this same. In this case, it can be provided that the motor control system shuts off the motor and preferably changes it into a reversing operating mode of the motor in order thus to discharge the document from the document shredder.

c) Illustrative Embodiments

Embodiments according to the invention are explained on an illustrative basis in greater detail below, wherein.

Figure 1:
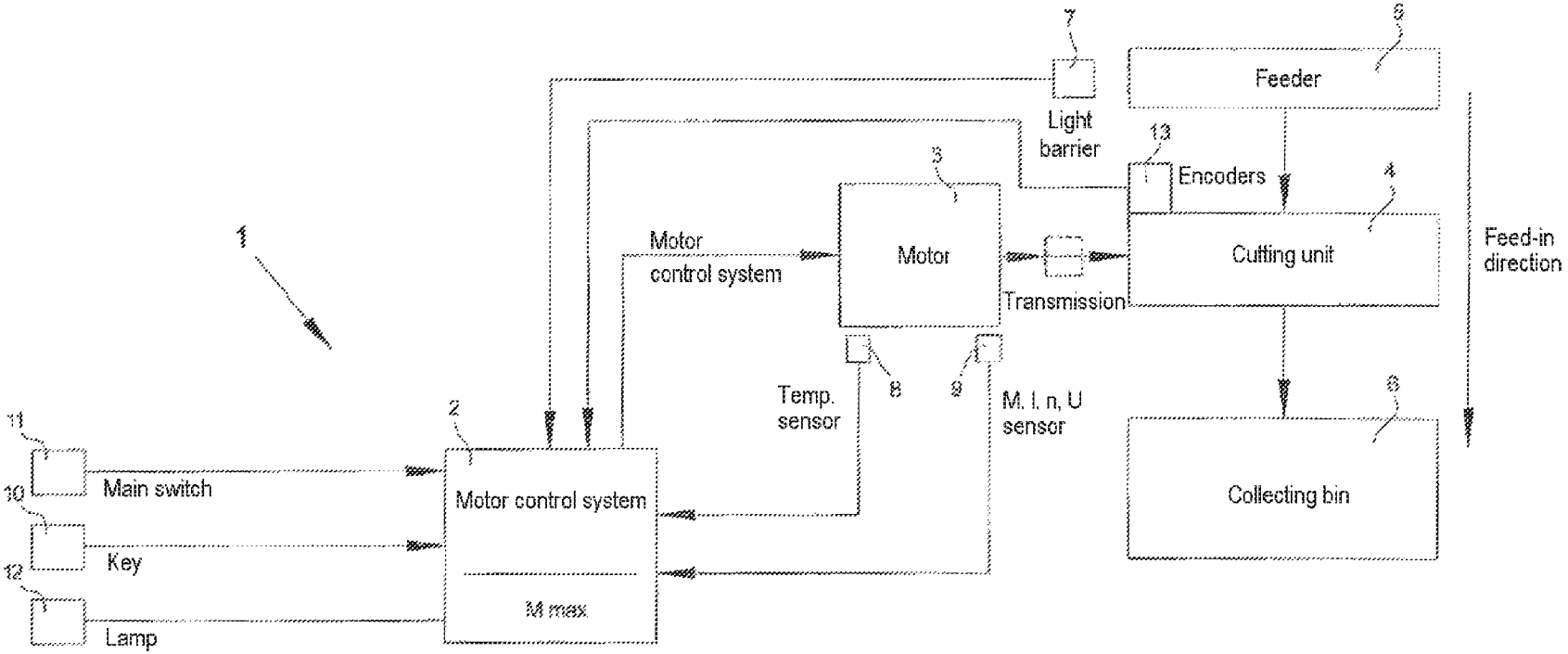
FIG. 1 shows a schematic representation of an inventive document shredder.

FIG. 1 shows a block diagram of the inventive document shredder. The document shredder 1 has a motor 3, which via a transmission drives a cutting unit 4. Upstream of the cutting unit 4 in the feed-in direction, i.e. in the direction of shredding of the document to be shredded, is located a feeder 5. Downstream of the cutting unit 4 in the feed-in direction is disposed a collecting bin 6, which can be, for example, a plastics container.

The motor 3 is regulated by a motor control system 2. To this end, the motor control system 2 on the one hand controls the motor 3 by adjustment of its operating parameters, such as, for example, the motor current and/or the motor voltage. For this, an external energy source (not shown), such as, for example, an accumulator or a mains current connection, supplies the motor control system 2 and/or the motor 3 with electric power. In addition, a rectifier (likewise not shown) and a circuit for current and/or voltage adaptation, which are connected upstream of the motor 3, can be provided. Hence, the control of the motor 3 can also be effected via a driving of the circuit for current and/or voltage adaptation by the motor control system 2.

The document shredder further has a rotary encoder 13, which measures the rotation of the cutting unit 4 in order thus to determine the shredding progress, i.e. the length of the already shredded portion of the fed-in document to be shredded. This measurement value is transmitted to the motor control system 2, which controls the motor 3 in dependence on the measurement value.

The motor 3 can be constituted by a direct-current motor having permanent magnets in the stator. The motor can also have the form of any type of series-wound motors. The motor can thus be a series-wound machine configured as a direct-current motor or a series-wound machine configured as an alternating current motor. Consequently, the motor can also be constituted by a universal motor and/or a single-phase series-wound motor. The motor 3 can be constituted by a permanently excited direct-current machine or by an electrically excited direct-current machine. The use of a compound machine (i.e. a compound motor) or an externally excited machine is also conceivable, as well as the use of a bell-armature machine or a brushless direct-current machine. The use of a capacity motor having individually connectable capacitors or of an electric motor of choice is also conceivable.

The motor control system 2 sets a maximally allowed load limit value Mmax and operates the motor 3 during the shredding operation for as long as this maximally allowed load limit value Mmax is not reached. Preferably, if a direct-current motor is used, the maximally allowed load limit value Mmax is here defined by a maximally allowed operating current of the motor 3. If a capacity motor is used, the maximally allowed load limit value Mmax can be set by the number of connected capacitors.

Hence, the load limit value Mmax is thus constituted by a target value preset. In order to compare this target value preset with actual values of the motor 3, the document shredder 1 has a sensor and/or a measuring circuit 9, which measures one or more operating parameters of the motor 3, for example the torque M, the current I, the voltage U and/or the rotation speed n. The measurement can be made directly at the motor or at the circuit upstream of the motor, i.e. at the circuit for adaptation of the current and/or voltage. This measurement can also be constituted, however, by the rotation speed of the cutting unit 4, as determined by the rotary encoder. As a result of a measured stoppage of the cutting unit 4, a blockage of the cutting unit 4 can be recognized. The measurement is fed back to the motor control system 2. This then compares the actual value, i.e. the measurement by the sensor 9, with the target value preset, i.e. the maximum load limit value Mmax. If the actual value here reaches the target value, actions predefined by the motor control system 2 are triggered, as is explained in greater detail with reference to FIG. 2.

The target value preset, i.e. the maximum load limit value Mmax, can be constituted by a factory preset or a preset undertaken by the user. Preferably, the maximum load limit value Mmax does not here correspond to the actual maximally possible load limit of the motor 3, i.e. constitutes no motor characteristic value of the motor 3, but rather lies below it. The same is also intended to apply to the (later discussed) raised maximum load limit value Mmax.

The document shredder 1 further has a temperature sensor 8, which measures the temperature of the motor 3. The measurement result is fed back to the motor control system 2. If the motor temperature exceeds a predefined, maximally allowed value, the motor 3 is shut off by the motor control system 2.

In addition, the document shredder 1 has in the region of the feeder 5 a sensor 7, which detects the presence of a document to be shredded in the feeder 5. The sensor 7 is constituted, for example, by a light barrier or by a mechanically actuable rocker switch. The result of the sensor 7 is likewise fed back to the motor control system 2, the measurement result preferably being in the form of a binary value (presence/non-presence of paper), though a value representing the thickness of the document is also conceivable.

For the operation of the document shredder, this has one or more keys 10, 11. The key 11 constitutes the main switch of the document shredder 1, by means of which the document shredder can be switched on and off. At the point of switch-on, the motor control system 2 preferably firstly activates a standby mode of the document shredder, in which the shredding operation can be activated by the detection of the presence of a document by the sensor 7.

The further key 10 serves to trigger the reversing operating mode of the motor 3 and/or to trigger the turbo mode, in which the maximum load limit value Mmax is raised. It is also conceivable, however, for the document shredder 1 to have two separate keys for triggering of the two aforementioned functions. Furthermore, it is also possible for the document shredder 1 to have only one key in total, which acts as the main switch and serves to trigger the two aforementioned functions. The length/time span of the actuation of the key can here serve to differentiate between the individual functions.

Finally, the document shredder 1 optionally has a further lamp 12, which indicates whether the maximally allowed load limit value Mmax has been reached. Instead of the lamp 12, or additionally thereto, the document shredder 1 can also have other representation options, such as, for example, a beep.

Figure 2:
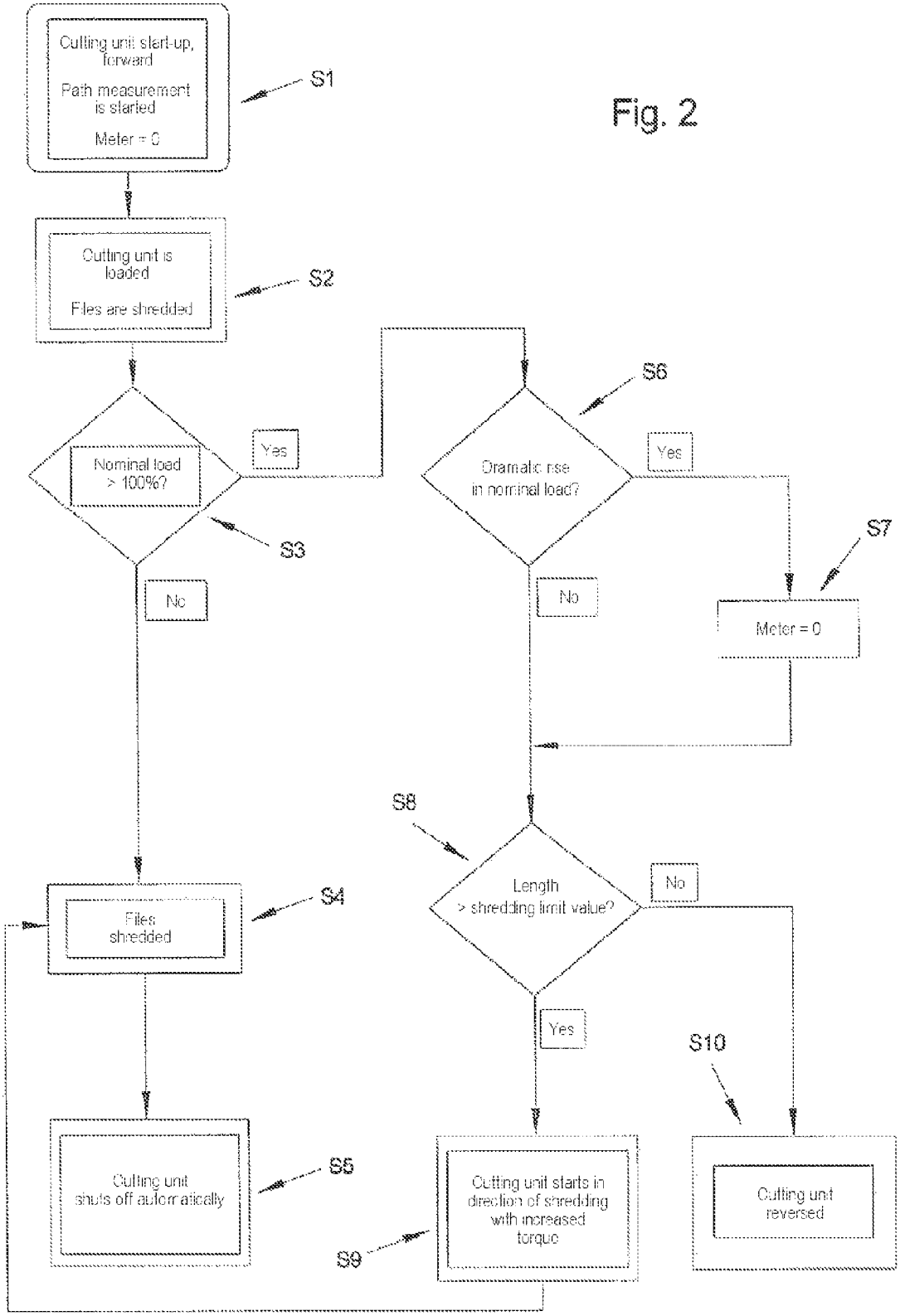
FIG. 2 shows a flow chart of the inventive method.

The inventive method shall now be described with reference to the flow chart of FIG. 2.

In step S1, the forward operation of the cutting unit 4 in the forward direction is started. For this it is first necessary for the main switch 11 (cf. FIG. 1) to be switched on, so that the document shredder 1 goes into standby mode. Next, if a document to be shredded is passed into the feeder 5, this is recognized by the sensor 7. After this, the forward operation of the cutting unit 4, as mentioned in step S1, is started. By forward direction should be understood that the cutting unit 4 draws in the document to be shredded and dissects it. Simultaneously with starting of the cutting unit 4, the path measurement is started. The meter of the path measuring device starts at the value "0". However, account is preferably taken of any path length or distance present between the feeder 5 and the cutting unit 4, so that the meter only then starts counting at zero when also the shredding of the document actually begins, i.e. the document has also actually reached the cutting unit 4. Alternatively, it is also conceivable for the start of the path measurement to be triggered only in step S3, i.e. once a load on the cutting unit 4 is detected.

The dissection, i.e. the shredding of the document, creates a load on the cutting unit which is dependent on the thickness and material of the document and which is transmitted via the transmission to the motor 3. This load, which is mentioned in step S2 and requires a commensurate torque of the motor 3, is measured by the sensor 9, for example by measurement of the motor current I. With increasing load, in a direct-current motor or a series-wound motor, the torque and the motor current rises strongly, while the motor speed falls. For this, the rotation speed of the cutting unit, which is measured by the rotary encoder 13 and which falls with increasing load, can also be taken into account.

In step S3, it is checked whether this actual load (i.e. the actual value of the motor 3) is less or greater than the predefined load limit value Mmax. In step S3, for determination of the actual load, the rotation speed of the cutting unit 4, determined by the rotary encoder 13, can also be adopted, wherein a low speed indicates a high load. Through a measured stoppage of the cutting unit 4, a blockage of the cutting unit 4, for example, can be recognized. In step S3, it can thus also be established whether the cutting unit 4 has a minimum rotational speed or, in the simplest case, whether it is still turning at all. The user can in step S3 be informed of the overload by the illumination or flashing of the lamp 12.

If the measured load is less than the predefined load limit value Mmax, then, as shown in step S4, the document (i.e. the file) is shredded.

As soon as this shredding is concluded, the cutting unit 4 is shut off in step S5 by shutting off of the motor 3. In order to establish whether the document has been completely shredded, the sensor 7 checks whether the document is still in the feeder 5. If this is no longer the case, then it can be assumed that the document will also shortly, i.e. for example within the next 1, 2 or 3 seconds, have been dissected by the cutting unit 4 placed downstream of the feeder 5. The shut-off according to step S5 thus takes place only after this fixedly set run-on time of, for example, 1, 2 or 3 seconds.

If in step S3 it is established, however, that the measured load is reaching the predefined maximum load limit value, or lies even above this, then in step S6 it is checked whether the measured load has dramatically increased. If this is the case, in step S7 the meter of the path measuring device is reset to the value "0". The aim of this is that the length, compared in step S8, of the already shredded portion of the document to be shredded is back at "0".

If in step S6, however, no dramatic rise in measured load is found, then the meter value of the path measuring device is not reset, but instead the process passes directly to step S8.

In step S8, the current length of the already shredded portion of the document to be shredded is compared with a predetermined shredding limit value. This shredding limit value can be constituted, for example, by the value "10 cm". If the meter values lies above this predetermined shredding limit value, then the predefined, maximally allowed load limit value Mmax is increased in step S9. The turbo mode, i.e. the turbo function of the document shredder, is thus activated. At the same time, the motor 3 is started and the cutting unit 4 is started in the feed-in direction, i.e. in the direction of shredding (which is opposite to the reversing direction). Since such a high load on the motor 3 and thus a higher torque is permitted, the document is subsequently completely shredded. Step S9 is thus followed by a document shredding, as has been described in steps S4 and S5.

The aim of this method performed in steps S8 and S9 is thus that an already relatively far shredded document, which thus lies only slightly above the maximally allowed load limit value Mmax, can nevertheless be shredded by raising of the load limit value Mmax. If a direct-current motor is used, the raising can be adjustable by raising of the maximally allowed motor current, if a capacity motor is used by connection of an additional, previously inactive capacitor. Any other chosen methods in which the torque of a chosen electric motor can be raised are also possible.

If in step S8, however, it is established that the length of the already shredded portion of the document to be shredded has not yet exceeded the predetermined shredding limit value of, for example, 10 cm paper length, i.e. lies below or equates to this, then the process passes to step S10. In step S10, the cutting unit 4 and also the motor 3 is reversed. Basically, the aim of the reversing operating mode is that the document is released from the document shredder, so that the user can either destroy the document in some other way (which can be necessary, for example, in the case of a digital data carrier) or, if it is a question of a stack of paper, can divide this into single thinner parts, which are then shredded individually by the document shredder 1. In this context, the aim of the reversing operating mode is that an only slightly shredded document, which clearly constitutes a significantly higher load than would be permitted by the maximally allowed load limit value Mmax, is discharged again from the document shredder. The reversing operating mode can optionally be triggered automatically in step S10, or alternatively by manual actuation of the key 10, which could be indicated by the lamp 12 by way of illumination or flashing. In the latter case, the manual capability for triggering the reversing operating mode has the function of enabling the user to initially take hold of the document to prevent it from falling down when being discharged. In the case of a manual triggering capability, an automatic triggering can also however automatically take place after a certain period in which the user is inactive, for example after 5 seconds.

After the increase in the maximum load limit value Mmax in step S9 and after a complete shredding of the document, as described in steps S4 and S5, not only is the cutting unit 4 and the motor 3 shut off (cf. step S5), but preferably also the raised load limit value Mmax is reset to its original value, as Is present in steps S1 to S8 and S10. The load limit value Mmax is thus raised only for a predetermined time (time span). This predetermined time is ended, i.e. its end is enforced by the motor control system 2, if the shredding of the document (as described in step S5) is concluded. It is also conceivable for the raised load limit value Mmax to be reset if the temperature sensor 8 reports an overheating of the motor 3.

Since a prolonged operation of the document shredder with raised load limit value Mmax can be undesirable, given that the transmission, the cutting unit 4 or the motor 3 may possibly suffer damage, the predetermined time can have a preset maximum value of, for example, one minute, the raised load limit value Mmax being automatically reset following expiry of this time.

Finally, the user is intended to have the possibility of being able to reset the raised load limit value Mmax manually, i.e. of being able to enforce the ending of the predetermined time. For this, he can switch off the document shredder 1, for example by actuation of the main switch 11 or by removal of the mains plug. There is also the possibility that, by short or long (i.e. longer than 3 seconds) actuation of the key 10, he resets the raised load limit value Mmax and, at the same time, stops the shredding operation.

Inventions embodied in various combinations and subcombinations of features, functions, elements, and/or properties may be claimed through a later related application, whether they are directed to a different invention or directed to the same invention, whether different, broader, narrower or equal in scope to the original invention, are also regarded as included within the subject matter of the inventions of the present disclosure.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the disclosure recites "a" or "a first" element or the equivalent thereof, such recitation should be understood to include incorporation of one or more such elements, neither requiring nor excluding two or more such elements.

Although the presently disclosed invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

REFERENCE SYMBOL LIST

1 document shredder
2 motor control system
3 motor
4 cutting unit
5 feeder
6 collecting bin
7 sensor (light barrier)
8 temperature sensor
9 load sensor
10 keys
11 main switch
12 lamp
13 rotary encoder
$M_{max}$ maximum load limit value

I claim:

1. A document shredder for the feed-in and shredding of documents, comprising:
a cutting unit;
a motor for driving the cutting unit;
a motor control system; and
a path measuring device;
wherein
the motor control system, via the path measuring device, determines a measured length of an already shredded portion of a document to be shredded; and
the motor control system controls the motor in dependence on the measured length of the already shredded portion of the document to be shredded.

2. The document shredder as claimed in claim 1, wherein
the document shredder includes a sensor for measuring a measured load on the motor, and
the motor control system controls the motor in dependence on a measured load on the motor.

3. The document shredder as claimed in claim 1, wherein
the motor control system has an overload limit predefining a maximum load limit value (Mmax) for the motor; and
the maximum load limit value (Mmax) is adjustable in dependence on the measured length of the already shredded portion of the document to be shredded.

4. The document shredder as claimed in claim 3, wherein the motor is a direct-current motor and/or a series-wound machine, and the motor control system defines the maximum load limit value (Mmax) by fixing of a maximally permitted current for operating the motor and/or by fixing of a maximally permitted motor torque and/or by fixing of a minimum rotation speed of the motor.

5. The document shredder as claimed in claim 3, wherein the motor is a capacity motor, and the motor control system is configured to increase the maximum load limit value (Mmax) by the connection of at least one capacitor.

6. The document shredder as claimed in claim 3, wherein the document shredder is configured so that the maximum load limit value (Mmax) is manually resettable.

7. The document shredder as claimed in claim 6, wherein the maximum load limit value (Mmax) is manually resettable by actuation of a main switch of the document shredder or by removal of a mains plug.

8. The document shredder as claimed in claim 3, wherein the motor control system is configured so that if the motor reaches the maximum load limit value (Mmax) before the measured length of the already shredded portion of the document to be shredded exceeds a predetermined shredding limit value the motor control system triggers a reversing operating mode of the motor.

9. The document shredder as claimed in claim 3, wherein the motor control system determines:

if the maximum load limit value (Mmax) is reached, and if the measured length of the already shredded portion of the document to be shredded has exceeded a predetermined shredding limit value;

and then the maximum load limit value (Mmax) is raised.

10. The document shredder as claimed in claim 9, wherein the motor control system determines:

if the motor reaches the maximum load limit value (Mmax) before the measured length of the already shredded portion of the document to be shredded exceeds the predetermined shredding limit value;

and then the motor control system triggers a reversing operating mode of the motor.

11. The document shredder as claimed in claim 10, wherein the reversing operating mode continues until the document to be shredded is ejected, based upon the measured length of the already shredded portion of the document to be shredded.

12. The document shredder as claimed in claim 10, wherein the triggering of the reversing operating mode and/or the raising of the load limit value (Mmax) is effected automatically by the motor control system and/or the reversing operating mode can be activated manually.

13. The document shredder as claimed in claim 12, further comprising a key configured to manually trigger the reversing operating mode of the motor and the raising of the maximum load limit value (Mmax).

14. The document shredder as claimed in claim 9, wherein the motor control system is configured so that when the maximum load limit value (Mmax) is reached, and before the maximum load limit value (Mmax) can be raised or the reversing operating mode can be triggered, the motor control system switches off the motor and/or temporarily operates the motor in a reversing operating mode, providing that the document to be shredded is not fully ejected.

15. The document shredder as claimed in claim 9, wherein the document shredder includes a sensor for measuring a motor current and/or a motor speed and/or a motor torque; and the motor control system is configured to determine, based upon at least one measured value and the maximum load limit value (Mmax), whether the load limit value is raisable.

16. The document shredder as claimed in claim 9, wherein the motor control system is configured to raise the maximum load limit value (Mmax) for a predetermined time or a predetermined yet to be shredded path length, and to reset the maximum load limit value (Mmax) after the predetermined time or path length, and at the same time to switch off the motor.

17. The document shredder as claimed in claim 9, wherein the motor control system is configured to shut off the motor if an already raised maximum load limit value (Mmax) is reached.

18. The document shredder as claimed in claim 17, wherein the motor control system is configured so that after shutting off the motor, the motor control system triggers a reversing operating mode of the motor.

19. The document shredder as claimed in claim 1, wherein the path measuring device is configured to measure a value representing a current shredding speed, and the measured length of the already shredded portion of the document to be shredded is determined via an integration of measured values of the current shredding speed.

20. The document shredder as claimed in claim 1, wherein the path measuring device further comprises at least one rotary encoder, where the rotary encoder is disposed on at least one of a cutting unit shaft, the motor, and a transmission step between the motor and the cutting unit.

21. The document shredder as claimed in claim 1, wherein the motor control system is configured to measure motor output and determine the measured length of the already shredded portion of the document to be shredded via an integration of the power consumption of the motor over time.

22. The document shredder as claimed in claim 21, wherein the motor control system is configured to measure a current consumption of the motor and determine the measured length of the already shredded portion of the document to be shredded via an integration of the current consumption of the motor over time.

23. The document shredder as claimed in claim 21, wherein the motor control system is configured so that an abrupt rise in the measured power consumption of the motor signals that additional documents have been supplied, and the motor control system resets the measurement of the measured length of the already shredded portion of the document to be shredded, and initiates a new measurement of a measured length of the already shredded portion of the document.

24. The document shredder as claimed in claim 1, wherein the document to be shredded is fed and/or shredded along a path, and the path measuring device is configured to determine a length of the path.

25. The document shredder as claimed in claim 24, wherein the motor control system is configured to determine the path length based upon the measured length of the already shredded portion of the document to be shredded.

26. The document shredder as claimed in claim 1, further comprising a sensor configured to recognize whether one or more documents to be shredded are located in a feeder of the document shredder, and the motor control system is configured to operate the motor for a run-on time and then end motor operation when the sensor recognizes that there are no documents in the feeder.

27. The document shredder as claimed in claim 26, wherein the sensor is one of a light barrier switch or a rocker switch.

28. The document shredder as claimed in claim 26, wherein run-on time is an adjustable run-on time.

29. The document shredder as claimed in claim 26, wherein run-on time is a fixedly set run-on time.

30. A method for operating a document shredder having a motor, comprising:

determining a determined length of an already shredded portion of a document to be shredded; and controlling the motor based on the determined length of the already shredded portion of the document to be shredded.

31. The method as claimed in claim 30, further comprising measuring a load on the motor; and controlling the motor based on the measured load on the motor.

32. The method as claimed in claim 31, wherein the document shredder is configured so that the actual load on the motor is limited by a predefined, maximum load limit value (Mmax), the method further comprising:

recognizing an overload condition based upon reaching the maximum load limit value (Mmax), where the maximum load limit value (Mmax) is adjustable and depends on the determined length of the already shredded portion of the document to be shredded.

33. The method as claimed in claim 32, wherein recognizing an overload condition further comprises operating the motor in a reversing operating mode; where the already shredded portion has not yet exceeded a predetermined shredding limit value.

34. The method as claimed in claim 33, wherein recognizing an overload condition further comprises operating initially and temporarily in reversing operating mode; and then switching the motor off.

35. The method as claimed claim 33, wherein operating the motor in the reversing operating mode includes automatically or manually triggering the reversing operating mode.

36. The method as claimed in claim 32, wherein recognizing an overload condition further comprises;

operating the motor in a turbo mode;

raising maximum load limit value (Mmax), provided that the turbo mode is only able to be triggered once the already shredded portion of the document to be shredded exceeds a predetermined shredding limit value.

37. The method as claimed claim 36, wherein operating the motor in the turbo mode includes triggering the turbo mode automatically or manually.

38. The method as claimed in claim 37, further comprising maintaining the turbo mode for a predetermined time.

39. The method as claimed in claim 38, further comprising lowering the maximum load limit value (Mmax) to its initial value after the predetermined time.

40. The method as claimed in claim 38, wherein maintaining the turbo mode includes maintaining the turbo mode until the document to be shredded has been completely shredded.

41. The method as claimed in claim 30, further comprising:

measuring a value representing a current shredding speed; and calculating the determined length of the already shredded portion of the document to be shredded by integrating the measured value.

42. The method as claimed in claim 30, further comprising:

measuring a motor output; and wherein determining the determined length of the already shredded portion of the document to be shredded includes integrating a power consumption of the motor over time.

43. The method as claimed in claim 42, wherein determining the determined length of the already shredded portion of the document to be shredded includes integrating a current consumption of the motor over time.

* * * * *